United States Patent [19]

Georgopulos

[11] 4,360,722

[45] Nov. 23, 1982

[54] DESIGNATION CAP ACTUATOR ASSEMBLY

[75] Inventor: Thomas Georgopulos, Roselle, Ill.

[73] Assignee: GTE Automatic Electric Labs Inc., Northlake, Ill.

[21] Appl. No.: 202,979

[22] Filed: Nov. 3, 1980

[51] Int. Cl.[3] ..... H01H 9/18

[52] U.S. Cl. ..... 200/314; 200/159 B; 200/317; 200/340

[58] Field of Search ..... 200/159 B, 314, 317, 200/5 A, 340

[56] References Cited

U.S. PATENT DOCUMENTS

| | | | |
|---|---|---|---|
| 3,917,917 | 11/1975 | Murata | 200/159 B |
| 4,029,916 | 6/1977 | Chu | 200/159 B |
| 4,032,729 | 6/1977 | Koistinen | 200/340 |
| 4,131,777 | 12/1978 | Bailey et al. | 200/314 |
| 4,163,883 | 8/1979 | Boulanger | 200/314 |
| 4,190,748 | 2/1980 | Langford | 200/159 B |

*Primary Examiner*—Willis Little

*Attorney, Agent, or Firm*—Robert J. Black; Anthony Miologos

[57] ABSTRACT

A momentary contact actuator and designation cap assembly designed to be used with a single switch of a laminated flat-panel keyboard. The assembly consists of a housing which snaps over the flat-panel switch, a cantilivered actuator located within the interior of the housing, a designation insert installed over the actuator including switch identification printed thereon, and a transparent cover installed over the insert. Manual pressure applied to the actuator operates the associated flat-panel switch.

5 Claims, 3 Drawing Figures

DESIGNATION CAP ACTUATOR ASSEMBLY

BACKGROUND OF THE INVENTION (1) Field of the Invention

This invention relates in general to laminated flat-panel switches and more particularly to a designation cap actuator assembly for laminated flat-panel switches.

(2) Description of the Prior Art

Flat-panel switches and keyboards constructed of laminated plastic and conductive substrates are currently utilized in electronic calculators and in other electronic apparatus for digital control and data entry. This type of panel switch provides a flat key assembly in which conventional electromechanical pushbuttoms are replaced by a relatively thin, flexible member having one side in a facing relationship with the switch elements so that deflection of the member in a particular area in response to force manually exserted on the other side of the member actuates a respective switch element.

Flat-panel switches offer the utmost in simplicity, low cost, space saving design features and low tooling investment. All of these factors are significant in comparison to comparable assemblies consisting of discrete electromechanical switch assemblies.

Currently flat-panel switches are limited in certain applications because the graphic designation (identification/labels) of switches are an integral part of the laminated assembly and therefore are limited to only fixed or permament switch labels. The use of flat-panel switch assemblies consequently are not suitable for product applications where switches are identified or assigned functions after manufacturer of the panel. Such as in key telephone systems or PABX console applications.

Therefore it becomes an object of the present invention to design a designation cap actuator which would provide the means of assigning designations to laminated flat-panel switches after the manufacture of the panel.

SUMMARY OF THE INVENTION

In accomplishing the object of the present invention the designation cap actuator consists of a three part assembly which snaps into a laminated flat-panel switch assembly. Application of the designation cap assembly is limited to momentary switch operation. Slots located on either side of an individual flat-panel switch are disposed to accept tabs on either side of an actuator housing rigidly holding the housing over the flat-panel switch. A domed shaped flexing actuator located within the interior of the housing includes a finger situated on a bottom surface of the actuator. When the housing is installed the actuator finger is located directly above the flat-panel switch. For actuators requiring illumination from either incandescent lamps or LED's, a hole at one end of the actuator is provided conforming to the configuration of the light source.

The second part of the assembly includes a designation strip comprised of a sheet of paper or plastic on which the identification or other designation messages may be printed, typed or handwritten. The designation strip is installed over the actuator and is also provided with a hole for allowing the source of illumination to be visible. The assembly is completed by a clear plastic designation cover with snaps into the housing over the designation strip.

Switch closure is accomplished by exserting a manual force downward with the finger along the actuator, which deflects downward allowing the actuator finger to depress the associated flat-panel switch closing the flat-panel switch contacts.

BRIEF DESCRIPTION OF THE DRAWINGS

A better understanding of the invention may be had from the consideration of the following detailed description taken in conjunction with the accompanying drawings in which.

DESCRIPTION OF THE PREFERRED EMBODIMENT

Figure 1:
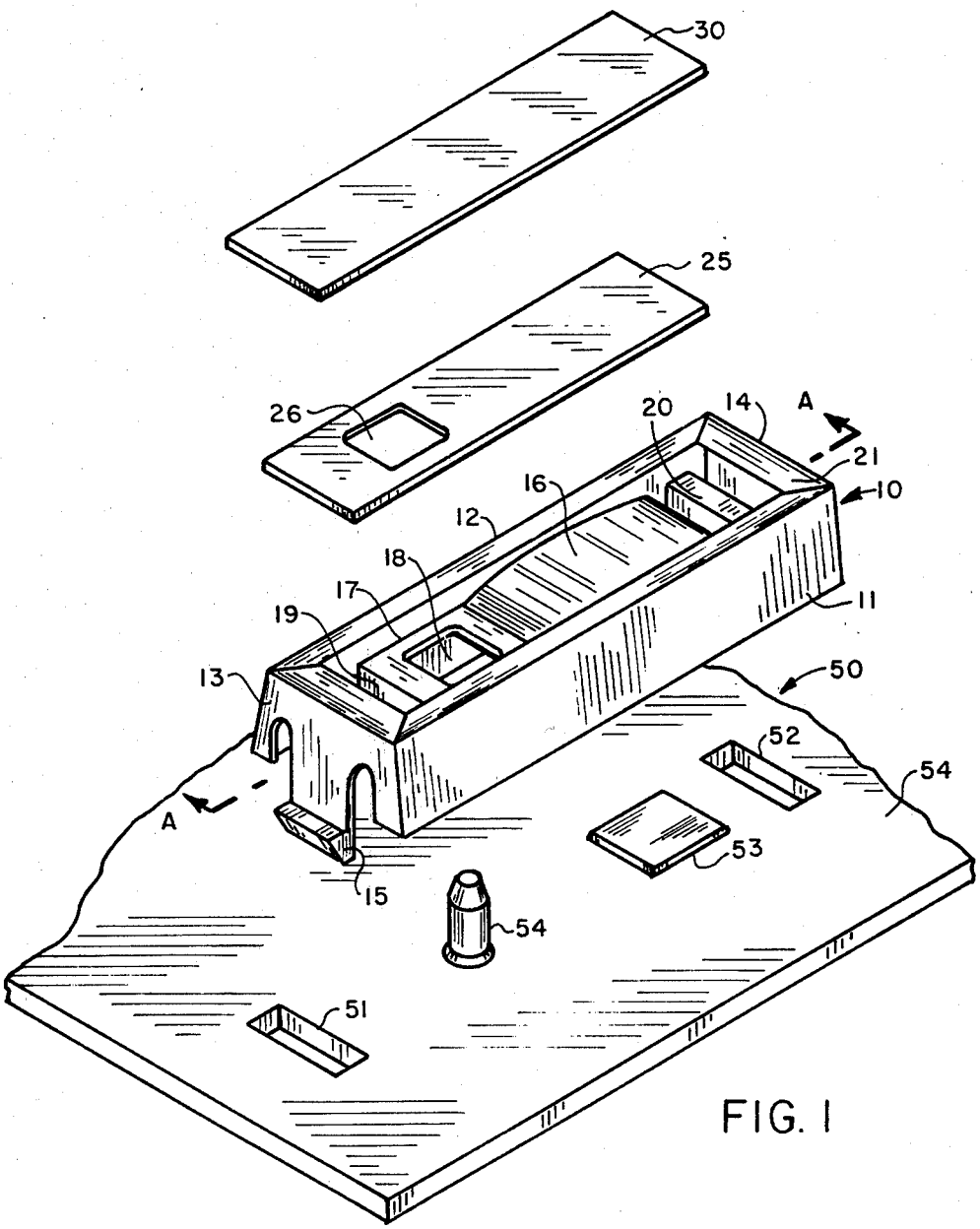
FIG. 1 is an exploded perspective view illustrating the various components of the designation cap actuator assembly and the manner in which it mounts on a laminated flat-panel switch in accordance with the present invention described herein.

Turning now to FIG. 1 of the included drawings the designation cap actuator assembly of the present invention is illustrated. The assembly is comprised of an actuator housing 10, a paper designation strip 25 and a thin clear plastic designation strip cover 30. The assembly is arranged to mount over a single switch of a laminated flat-panel switch assembly 50.

Figure 2:
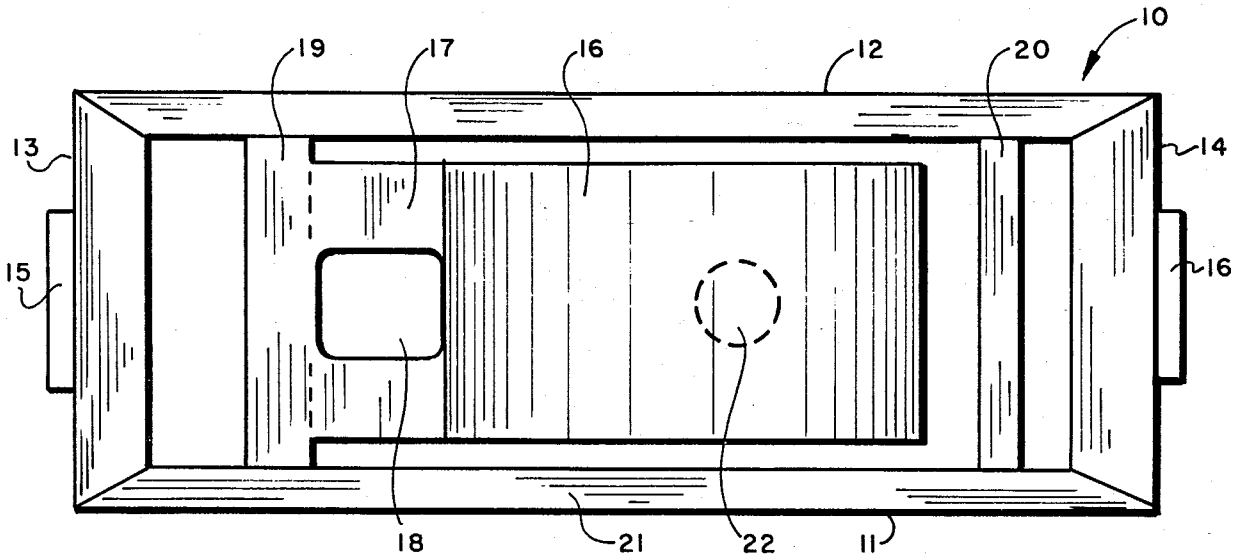
FIG. 2 is top view of the actuator housing in accordance with the present invention.

The housing 10 is composed of molded plastic as an unitary structure and includes rectangular side walls 11 and 12 and end walls 13 and 14. End walls 13 and 14 each include a locking member 15 and 16 respectively. Each locking member is arranged to be inserted into a respective one of slots 51 and 52 located on each end of an individual flat-panel switch. As can be also seen in FIG. 2 the housing further includes a cantilevered actuator comprised of a deflectable portion 16 and a hinge section 17 integrally joined to a transvers member 19 all situated within the interior of the housing. Deflectable member 16 is adapted to arcuately deflect about hinge section 17 when manual pressure is applied thereon. Hinge section 17 further includes an aperture 18 allowing light from light source 54 to be visible through the switch body. Member 19 and member 20 provide rigidity to the housing. A downwardly extending actuator finger 22 is integrally joined to a bottom surface of portion 16 and arranged to contact and depress flat-panel switch 53 when member 16 is urged downward. The switch body is completed by a perimeter lip 21 situated about the top periphery of the switch body housing. Lip 21 is arranged to hold designation strip 25 and plastic strip cover 30 over the actuator. It can be appreciated by those skilled in the art that any two opposing horizontal sections of lip 21 may be used to hold the designation insert 21 and cover 25, as well as all four sections, and that the invention is not limited thereto.

Figure 3:
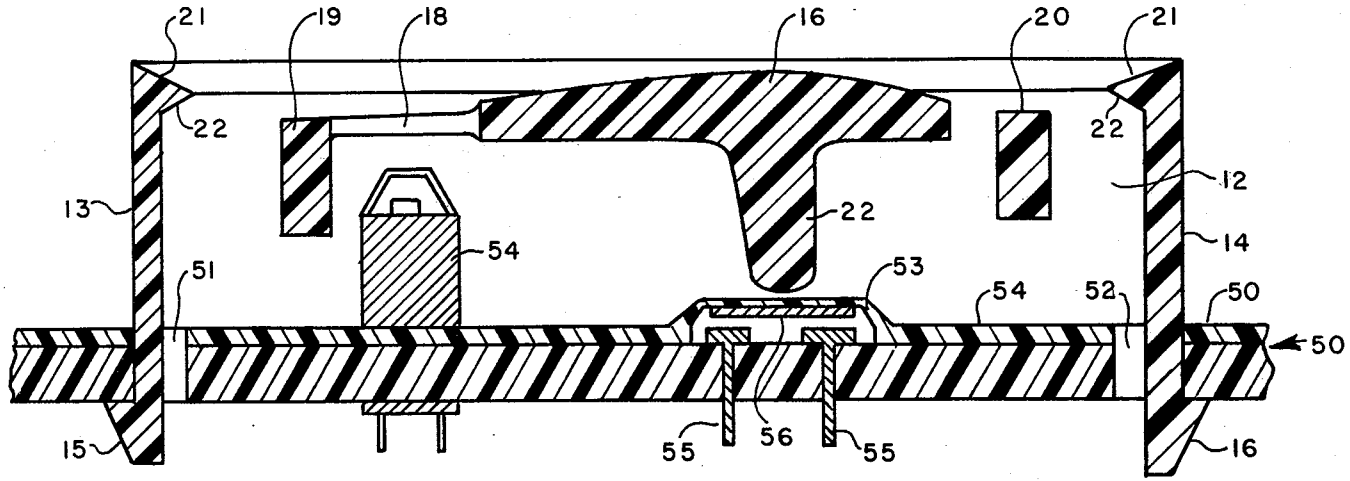
FIG. 3 is a sectional view of a mounted actuator housing taken substantially along line A—A of FIG. 1.

Turning now to FIG. 3 the actuator housing is shown in section mounted to a typical laminated flat-panel switch. As can be seen laminated switch 53 is comprised of a raised area having internal conductor portions 55 and 56. Each of conductors 55 would be electrically connected to a source of electrical current and would pass current when pad 53 is urged downward allowing conductive portion 56 to contact conductors 55. Locking members 15 and 16 are inserted within slots 51 and 52 allowing legs 15 and 16 to interlockingly engage the bottom surface of the laminated panel 50. As can be seen, the bottom edge of walls 11 (not shown) and 12 fit flush against surface 54 of panel 50 with the housing installed. Finger 22 of actuator member 16 is situated directly above pad 53 and a manual force applied to member 16 will allow the member to deflect downward with finger 22 depressing pad 53 allowing conductor 56 to bridge conductors 55. With manual pressure removed member 16 springs back to its original position.

Paper designation strip 25 (not shown) is of a size to fit over the housing opening and is held on its bottom surface by actuator member 16 and its top surface by a respective underside 22 of lip 21. Any form of labeling may be applied to the paper strip for switch identification. The designation strip is further provided with a hole 26 which when installed is situated about the perimeter of aperture 18 of the actuator.

Likewise the clear plastic designation cover 30 is of the same size as the designation strip and is arranged to install in the same manner as designation strip 25.

The switch body may be removed by applying an inward pressure to end walls 13 and 14 allowing legs 15 and 16 to be lifted out of slots 51 and 52.

The present invention has been described with reference to a specific embodiment thereof, for the purpose of illustrating the manner in which the invention may be used to advantage. It will be appreciated by those skilled in the art that the invention is not limited thereto. Accordingly, any and all modifications, variations, or equivalent arrangements which may occur to those skilled in the art should be considered to be within the scope of the invention.

What is claimed is:

1. A designation cap actuator adapted to cooperate with circuit closing means, said circuit closing means including a circuit board having conductors thereon, a resilient dome contact element in spaced apart relationship to said conductors and adapted to make contact with said conductors upon the application of a force thereon, said circuit board further including a pair of slots extending through said circuit board each on an opposite side of said dome switch element, said designation cap actuator comprising:

an actuator housing having at least two horizontally oriented walls situated on opposite ends of the top periphery of said housing and defining an opening therebetween, said housing further including a pair of legs each leg including locking means and each of said locking means inserted into a different one of said slots interlockingly engaging said housing to said circuit board about said dome contact element;

a cantilevered actuator situated internally within said housing and including top and bottom surfaces, said actuator further including a hinge section for integrally connecting the actuator to said housing and allowing said actuator to deflect downward when manual pressure is applied to said top surface and return to its original position when manual pressure is relieved, said bottom surface including a finger extending from said bottom surface in juxtaposition to said dome contact element; and a designation insert arranged to accept identifying indicia on a top surface thereof, and adapted to install over said actuator top surface with a portion of the perimeter of said insert top surface resting under said housing walls;

whereby, in response to manual force applied to said designation insert top surface, said actuator is deflected downward, and said actuator finger contacting said dome contact element urging said dome contact element to make contact with said conductors; said circuit board further including a source of illumination and said hinge section including an opening situated in direct alignment with said source of illumination allowing said source of illumination to be visible when said housing is installed on said circuit board.

2. A designation cap actuator as claimed in claim 1, wherein: said designation cap actuator further comprises a transparent designation cover arranged to install over said designation insert top surface with a portion of the perimeter of said cover resting under said housing walls.

3. A designation cap actuator as claimed in claim 1, wherein: said actuator housing is rectangularly shaped including vertical left and right side walls and vertical front back and back end walls each of said end walls having said legs extending downwardly therefrom terminating in a triangular shaped member comprising said locking means.

4. A designation cap actuator as claimed in claim 1, wherein: said actuator housing includes a transversely orientated member in the interior of one end of said housing, said hinge section being integrally joined to said transverse member and having a cross section less than said actuator.

5. A designation cap actuator as claimed in claim 4, wherein: said designation insert includes an opening in alignment with said hinge opening allowing said source of illumination to be visible when said designation insert is installed on said actuator.

* * * * *